US005797996A

United States Patent [19]

Milocco et al.

[11] Patent Number: 5,797,996

[45] Date of Patent: Aug. 25, 1998

[54] METHOD FOR CONTROLLING THE AMOUNT OF WATER FILLED IN A DISHWASHING MACHINE

[75] Inventors: Claudio Milocco, Trieste; Gianluca Tassotti, Pordenone, both of Italy

[73] Assignee: Electrolux Zanussi Elettrodomestici S.p.A., Pordenone, Italy

[21] Appl. No.: 924,968

[22] Filed: Sep. 8, 1997

[30] Foreign Application Priority Data

Sep. 12, 1996 [IT] Italy ..... PN96A0051

[51] Int. Cl.[6] ..... B08B 7/04

[52] U.S. Cl. ..... 134/18; 134/25.2

[58] Field of Search ..... 134/18, 25.1, 25.2, 134/34, 56 D, 56 R, 57 R, 57 D, 58 R, 58 D; 68/12.23, 12.11, 12.17, 12.02

[56] References Cited

U.S. PATENT DOCUMENTS 5,313,964 5/1994 Daush et al. ..... 134/57 D
5,330,580 7/1994 Whipple, III et al. ..... 134/57 D
5,409,023 4/1995 Santarossa et al. ..... 134/58 D
5,494,062 2/1996 Springer ..... 134/58 D
5,525,161 6/1996 Milocco et al. ..... 134/18

*Primary Examiner*—Jill Warden
*Assistant Examiner*—Alexander Markoff
*Attorney, Agent, or Firm*—Pearne, Gordon, McCoy and Granger LLP

[57] ABSTRACT

A method for controlling the amount of water filled in a dishwashing machine through a normally closed valve (18) to carry out a duty cycle of the machine in which the water is sprayed onto the washload items by a circulation pump (10) driven by an electric motor (11). The water is put under pressure by the pump in an intermittent manner with an alternate sequence of pre-set operating periods (T) and pauses (S) during which the motor rotating speed is at its highest value ($V_1$) and lowest value ($V_0$), respectively. The valve (18) is opened in at least one subsequent pause (S) following a preceding period (T) in which the pressure of the water in correspondence of the pump (10) decreases below a pre-determined threshold value ($P_2$).

5 Claims, 2 Drawing Sheets

METHOD FOR CONTROLLING THE AMOUNT OF WATER FILLED IN A DISHWASHING MACHINE

BACKGROUND OF THE INVENTION

The present invention generally relates to an improved method for automatically controlling the amount of the water being filled in a dishwashing machine, in particular a dishwashing machine adapted to carry out duty cycles and programs that call for an intermittent operation of the washload spraying means.

U.S. Pat. No. 5,525,161 discloses such a duty cycle for dishwashing machines that includes washing phase and/or a rinsing phase. Each phase is controlled by a program sequence control switch and includes in turn, a water fill phase during which water is let into a collection sump in the machine up to a certain static level, in view of it being then sprayed on to the washload items through appropriate spray means that are supplied by a circulation pump having a suction intake whose top portion is situated at a pre-determined level in said collection sump. The water is sprayed by said spray means on to the washload in an intermittent manner. That is according to an alternate sequence of spray periods and pauses during which the pressure of the water downstream of the pump is at its highest and its lowest value, respectively. Each of said spray periods has a duration substantially equal to the time in which the water in the sump, due to its being taken in by the pump and delivered in suspension by the spray means, decreases from said static level down to said pre-determined level of the suction intake of the pump. Furthermore, each one of said pauses has a duration which is substantially equal to the time in which the water in the sump, into which the water in suspension in the interior of the machine tends to fall back and collect by gravity, increases again from said pre-determined level up to said static level.

Such a duty cycle can be carried out in a dishwashing machine of a substantially traditional type and advantageously enables the energy usage by the machine to be drastically reduced without affecting the overall performance capabilities of the same machine. However, the actual reduction in water usage, an increasingly important issue nowadays, is still unsatisfactory because the water is filled in the dishwashing machine up to a "static" level, which may inherently involve inaccuracies.

The amount of water being filled in a dishwashing machine can on the other hand be controlled with a greater degree of accuracy by having resort to a dynamic control method, such as the one described in EP O 118 719, which is adapted to control the operation of a water inlet valve of a dishwashing machine, the circulation pump of which is operating during the water filling phase to be controlled. An appropriate transducer means delivers a control signal which is in a relation with the pump delivery pressure and which includes a continuous component and a damped oscillating one.

When the amplitude of the variations of the control signal decreases below a pre-determined value the water inlet valve is caused to close. This control method can actually operate on the basis of any physical quantity that is representative of the delivery pressure of the circulation pump of the dishwashing machine, such as the rotating speed of the pump and/or the driving motor thereof, which may for example be detected by means of a tachometer.

In principle, such a prior-art control method enables optimized and particularly accurate water filling phases to be carried out in a manner that is independent of the main variables of the water-carrying system, such as for instance the line pressure of the water supplied to the machine.

On the other hand, this method involves the processing of signals that are subject to minimum variations that may most easily be altered by the noise that can for example be caused by disturbances in the power supply or accidental variations occurring in the water-carrying system, such as air bubbles and the like.

Conclusively, then, the method cannot be considered accurate and reliable to any sufficient extent, unless undesired and expensive complications are introduced in the overall construction of the machine.

BRIEF SUMMARY OF THE INVENTION

It would therefore be desirable, and is a purpose of the present invention, to provide a method for controlling the amount of water being filled in a dishwashing machine which, while ensuring an unaltered standard of performance of the machine, is capable of effectively ensuring a drastic reduction not only in the energy usage, but also, and in particular, in the water usage thereof.

It is in particular a main purpose of the present invention to provide a method of the above stated type, which is particularly accurate, can be implemented through the use of most economical and reliable means, and enables a minimum amount of water to be used to ensure an optimum operation of the dishwashing machine.

According to the invention, these and further aims are reached in a method for controlling the amount of water filled in a dishwashing machine including the features and characteristics as recited in the appended claims.

BRIEF DESCRIPTION OF THE SEVERAL VIEWS OF THE DRAWING

The characteristics and the advantages of the invention will be readily understood from the description that is given below by way of non-limiting example with reference to the accompanying drawings, in which.

DESCRIPTION OF THE INVENTION

Figure 1:
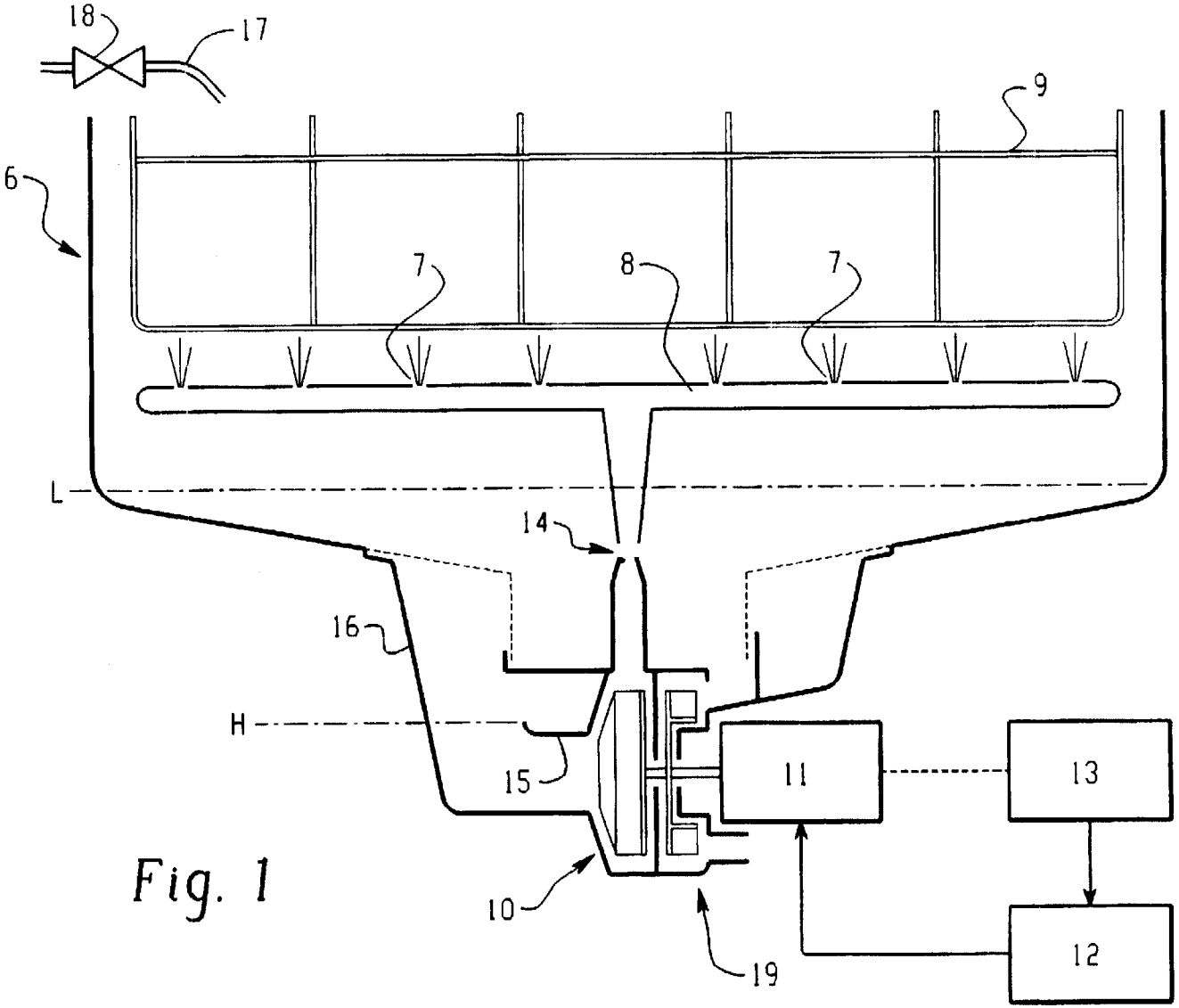
FIG. 1 is a schematic and partial sectional view of an automatic dishwashing machine adapted to carry out the control method according to the present invention, in a preferred embodiment thereof.

With reference to FIG. 1, the dishwashing machine may have a structure of any substantially known type, such as described in the afore cited patent specification U.S. Pat. No. 5,525,161. Said dishwashing machine mainly comprises a washing vessel 6 housing spray means including at least a rotating spray arm 8 provided with a plurality of spray nozzles 1. These nozzles are adapted to spray the washload items, which are appropriately arranged in a basket 9, with water that is put under pressure by a circulation pump 10 which is preferably of the centrifugal type and is driven by an electric motor 11. The motor 11, along with all other main operational parts and members of the machine, is controlled by a program sequence control switch 12 to automatically carry out one or more programs that can be selected by the user and include a method according to the present invention for controlling the amount of water being filled in the dishwashing machine.

The motor 11 is connected to a control arrangement, such as a tachometer 13, which is adapted to drive the program sequence control switch 12 with a signal that is indicative of the actual rotating speed of the motor and, therefore, the pump 10.

The rotating spray arm 8 is connected via a conduit 14 to the delivery of the circulation pump 10, the suction intake 15 of which is situated in a sump 16 of the vessel 6, where the water let into the machine through a supply conduit 17 provided with normally closed valve means 18 controlled by the program sequence control switch 12 collects. In a known manner, the electric motor 11 may be adapted to also operate a drain pump 19.

Figure 2:
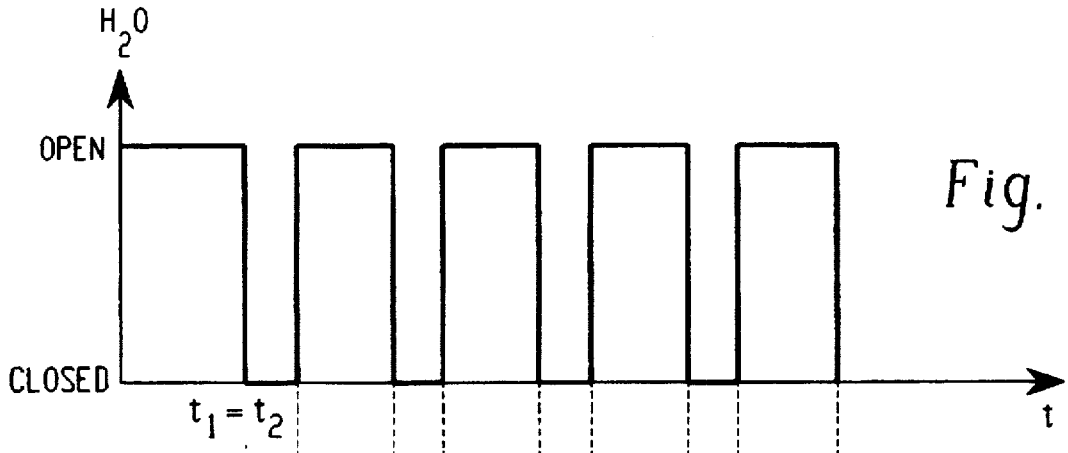
FIG. 2 is a timing diagram of the various phases of the water fill process in a dishwashing machine making use of the control method according to the invention, in a preferred embodiment thereof.
Figure 3:
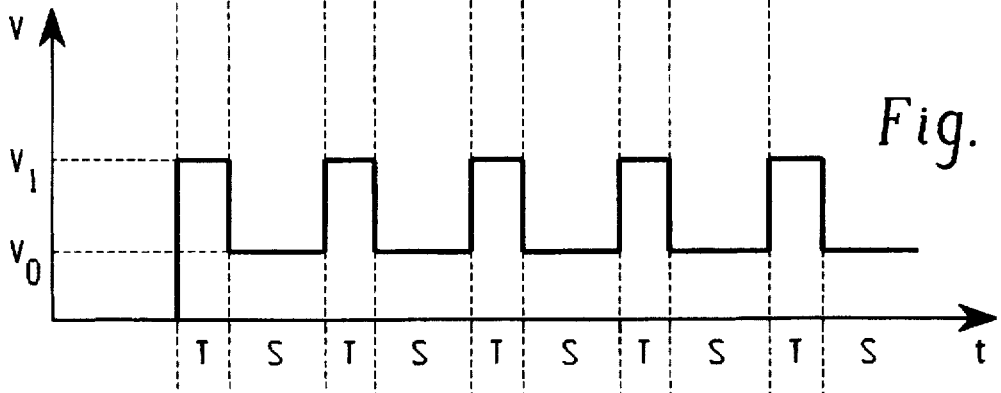
FIG. 3 is a timing diagram, in a preferred embodiment, of the operation phases of the motor driving the circulation pump that is provided in the dishwashing machine shown in FIG. 1.
Figure 4:
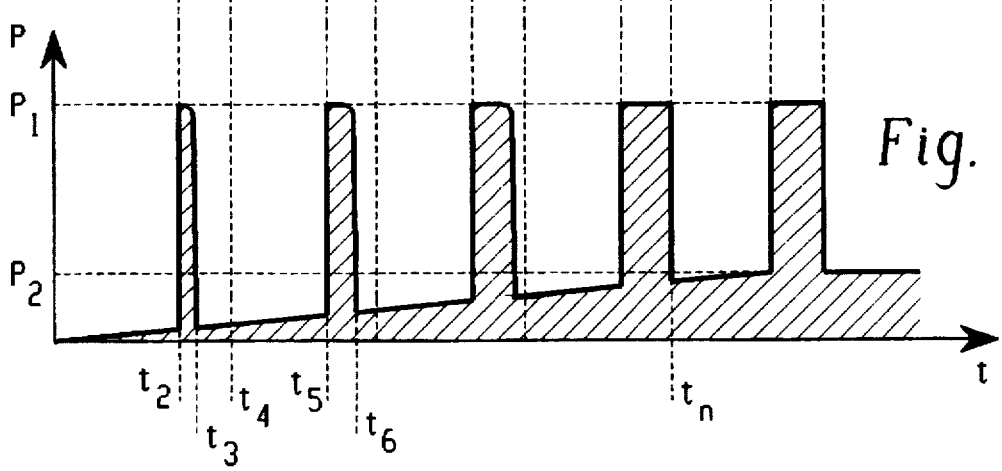
FIG. 4 is a timing diagram of the variations in the water pressure in correspondence of the circulation pump (in particular, at the delivery side of said pump) that is provided in the dishwashing machine of FIG. 1.

Referring also to FIGS. 2 to 4, a water fill phase that is a part of any duty cycle that can be carried out by the dishwashing machine includes controlling the amount of water let into the machine with the method according to the present invention.

Said water fill phase (FIG. 2) starts $t_0$ at an instant at which the program sequence control switch 12 opens the valve 18 under resulting delivery of water from the mains into the collection sump 16. In a preferred manner, said valve 18 stays open for a pre-determined initial period, up to an instant $t_1$ in which the circulation pump 10 is de-energized, that is does not operate.

If required, said initial period $t_0$–$t_1$ may be calculated, according to the actual characteristics of the overall water-carrying circuit of the machine, in such a manner as to let into the collection sump 16 a partial amount of water, that is, an amount of water that is not sufficient to allow for the circulation pump 10 to be able to completely prime.

At an instant $t_2$, which preferably coincides with the instant $t_1$, the program sequence control switch 12 energizes of the motor 11. The motor drives the circulation pump 10 through an alternate sequence of operating periods T and pauses S in which the motor 11 has a maximum rated or maximum nominal speed $V_1$ and a minimum rated or minimum nominal speed $V_0$, respectively (FIG. 3). Such an alternate sequence is substantially of the type described in the afore mentioned specification U.S. Pat. No. 5,525,161, with operating periods T and pauses S that are pre-set in accordance with the overall sizing of the machine and may for example have a duration of approximately 1 second and approximately 3 seconds, respectively. In a preferred manner, the duration of the operating periods T is substantially equal to the time in which, under regular or steady-state operating conditions, the water in the sump 16, due to its being taken in by the pump 10, decreases from a maximum level L down to the level H of the suction intake 15 of the same pump. Anyway, the duration of the operating periods T and/or the pauses S may vary depending on the different duty cycles that may be selectively carried out by the dishwashing machine.

As illustrated in FIG. 4, at the instant $t_2$ the pressure P of the water in correspondence of the circulation pump 10 rises sharply (practically in an instantaneous, abrupt manner) up to a peak value $P_1$. However, since the water in the sump 16 is still insufficient, it is rapidly exhausted by the pump 10 which conveys it toward the rotating spray arm 8. In other words, the pump 10 becomes substantially empty and tends to operate under "dry" conditions, that is without any water in it.

As result, the pressure of the water in correspondence of the pump 10 rapidly decreases to a minimum value, as this is shown in FIG. 4, and the pump itself represents, for its driving motor 11, a load that tends to decrease correspondingly. As a result, the actual rotating speed of the motor 11 tends to increase and the control arrangement 13 drives the program sequence control switch 13 with a signals that varies correspondingly, that is in a manner that is in a relation with the above cited pressure P of the water. As illustrated in FIG. 4, at an instant $t_3$ (which is comprised in the period T started at the instant $t_2$) the pressure of the water in correspondence of the pump 10 decreases below a pre-determined threshold value $P_2$ wherein even such a threshold value $P_2$ is pre-set in accordance with the overall sizing of the machine in such a manner as to ensure a correct spraying of the washload items.

According to a feature of the present invention, the program sequence control switch 12 is arranged and set so as to command the water inlet valve 18 to open during at least one pause S following a period T in which the pressure P of the water in correspondence of the pump 10 decreases below said pre-determined threshold value $P_2$. In the herein described example, therefore, a pause S starts at an instant $t_4$ during which the motor 11 is either de-energized or slowed down, and the valve 18 is opened to let a further amount of water into the washing vessel 6.

At a subsequent instant $t_5$ a new period T starts which is similar to the afore described one and during which it is assumed that the pressure of the water in correspondence of the pump 10 first reaches an initial peak value $P_1$ and then decreases below said threshold value $P_2$ after a time $(t_5-t_6)>(t_2-t_3)$. The difference between the time $(t_5-t_6)$ and the time $(t_2-t_3)$ corresponds to the amount of water that is let into the machine during the pause S between the instants $t_4$ and $t_5$.

The operation of the machine now continues on in the afore described manner with an alternating sequence of water fill phases (during the pauses S) and partial peaks of the water pressure (during the periods T). When the pressure P of the water in correspondence of the pump 10 remains above the threshold value $P_2$ and substantially stays at the value $P_1$ during an entire period T, ending at time $T_n$, the total amount of water filled into the vessel 6 has reached the minimum value that is required to ensure a correct priming of the circulation pump 10 and, as a result, a correct washing action of the rotating spray arm 8. Then the valve 18 remains closed so as to terminate water filling.

Through the tachometer arrangement 13, such a condition is detected by the program sequence control switch 12, which at this point commands the electromagnetic valve 18 to close so as to terminate the process of filling water in the machine. The operation of the dishwashing machine then goes on in a known manner, such as is described in the afore mentioned document U.S. Pat. No. 5,525,161.

From the above description it is apparent that the control method according to the invention is particularly accurate, since it is of a "dynamic" type and enables the actual priming conditions of the pump 10 to be measured by successive approximations. It should further be noticed that in the periods T in which the pressure of the water decreases below the threshold value $P_2$ (as described above), the pressure falls rapidly, that is with a steep slope, as shown in FIG. 4. This means that the transition point of the pressure curve P through the threshold $P_2$, that is the crossing of the threshold $P_2$ by the pressure curve P shown in FIG. 4 (and, as a result, the corresponding variations in the speed of the motor 11) during the periods T can be most readily and accurately detected by any control arrangement, which may therefore be implemented using simple, reliable and inexpensive electronic circuits.

It will be appreciated that the above described control method may be subject to a number of modifications without departing from the scope of the present invention.

For instance, in order to ensure sufficient water filling even in the presence of possible faults or disturbances in the water-carrying and spraying system of the machine, the program sequence control switch 12 can be most easily set so as to only terminate the water filling process when the pressure P of the water stays at a value above the threshold $P_2$ during at least two subsequent operating periods T.

Furthermore, or alternatively thereto, the program sequence control switch 12 can be most easily set so as to only terminate the water filling process after a predetermined delay time is allowed to elapse from the end of at least one period T during which the pressure P stays at a value which is greater than the threshold value $P_2$.

What is claimed is:

1. Method for controlling the amount of water being filled in a dishwashing machine including normally closed valve means (18); a program sequence control switch (12) controlling the valve means; spray means (7); a circulation pump (10) supplying the spray means; an electric motor (11) driving the pump and controlled by said program sequence control switch; and pressure sensing means for determining pressure of the water at the circulation pump, the method comprising the steps of:

energizing the circulation pump to pressurize the water in an intermittent manner with an alternating sequence of pre-set operating periods (T) and pauses (S) during which a nominal rotating speed of the motor is at its highest value rated ($V_1$) and its lowest value ($V_0$), respectively;

spraying the water on washload items through the spray means;

sensing the pressure of the water at the circulation pump; and characterized by opening said valve means (18) in at least one pause (S) following a period (T) during which the pressure of the water at the pump (10) decreases below a pre-determined threshold value ($P_2$).

2. Method according to claim 1, characterized in that, prior to said sequence of periods (T) and pauses (S), said valve means are opened for a pre-set period of time ($t_0$–$t_1$) so as to enable a partial water filling phase to be carried out in the machine.

3. Method according to claim 1, characterized in that, when the pressure of the water at the pump (10) persistingly stays above said threshold value ($P_2$) until the end ($t_n$) of at least one period (T), the valve means (18) are closed so as to terminate the water filling process in the machine following a certain delay after said end ($t_n$) of said period.

4. Method according to claim 1, characterized in that the valve means (18) are closed so as to terminate the water filling process in the machine when the pressure of the water at the circulation pump (10) remains above said threshold value ($P_2$) during at least two successive periods (T).

5. Method according to claim 1, wherein said pressure sensing means is a tachometer arrangement (13) producing a signal that is indicative of the actual rotating speed of said circulating pump driving motor (11) and said signal is delivered to said program sequence control switch (12).

* * * * *